US012808533B2

(12) United States Patent
Tuckey

(10) Patent No.: US 12,808,533 B2
(45) Date of Patent: Nov. 24, 2026

(54) STEAM GENERATOR AND METHOD

(71) Applicant: Charles Tuckey, Cass City, MI (US)

(72) Inventor: Charles Tuckey, Cass City, MI (US)

( * ) Notice: Subject to any disclaimer, the term of this patent is extended or adjusted under 35 U.S.C. 154(b) by 389 days.

(21) Appl. No.: 18/636,647

(22) Filed: Apr. 16, 2024

(65) Prior Publication Data

US 2024/0353093 A1 Oct. 24, 2024

Related U.S. Application Data

(60) Provisional application No. 63/496,772, filed on Apr. 18, 2023.

(51) Int. Cl.

| | |
|---|---|
| ***F22B 1/18*** | (2006.01) |
| ***F22B 3/04*** | (2006.01) |
| ***F22B 13/04*** | (2006.01) |
| ***F22B 15/00*** | (2006.01) |
| ***F22B 27/08*** | (2006.01) |
| ***F22B 27/16*** | (2006.01) |
| ***F22D 1/02*** | (2006.01) |
| *F22D 5/34* | (2006.01) |

(52) U.S. Cl.

CPC ..... *F22B 1/1869* (2013.01); *F22B 3/04* (2013.01); *F22B 13/04* (2013.01); *F22B 15/00* (2013.01); *F22B 27/08* (2013.01); *F22B 27/16* (2013.01); *F22D 1/02* (2013.01); *F22D 5/34* (2013.01)

(58) Field of Classification Search

CPC ..... F22B 1/1869; F22B 3/04; F22B 13/04; F22B 15/00; F22B 27/08; F22B 27/16; F22D 1/02; F22D 5/34

See application file for complete search history.

(56) References Cited

U.S. PATENT DOCUMENTS 1,627,668 A * 5/1927 Robbins ..... F22B 27/16 122/408.1
2,718,218 A * 9/1955 Gray ..... F22B 27/16 122/504
5,161,488 A * 11/1992 Natter ..... F23G 7/065 236/14

* cited by examiner

*Primary Examiner* — Michael G Hoang
*Assistant Examiner* — Kurt J Wolford
(74) *Attorney, Agent, or Firm* — Robert L. Stearns; Dickinson Wright PLLC

(57) ABSTRACT

A steam generator for converting a fluid to steam includes a combustion chamber for receiving a combustion fuel into the combustion chamber. A steam chamber surrounds and is heated by the combustion chamber to a temperature exceeding a vaporization temperature of the fluid. A heat exchanging chamber surrounds and is heated by residual heat of the steam chamber. A preheating coil is disposed within the heat exchanging chamber and has a fluid inlet for receiving the fluid under pressure into the preheating coil for preheating the fluid within the heat exchanging chamber. An injector communicates with the preheating coil and the steam chamber for injecting a controlled flow of the preheated fluid under pressure into the steam chamber where it flashes to steam and is super-heated to the temperature of the steam chamber. A steam outlet conveys the super-heated steam externally of the steam generator.

4 Claims, 3 Drawing Sheets

STEAM GENERATOR AND METHOD

CROSS-REFERENCE TO RELATED APPLICATION

This U.S. Utility application claims the benefit of U.S. Provisional Application Ser. No. 63/496,772, filed Apr. 18, 2023, which is incorporated herein by reference in its entirety.

1. TECHNICAL FIELD

This invention relates generally to devices for generating steam and more particularly to those utilizing heat exchangers.

2. RELATED ART

Power plants, including steam-powered engines, rely on input of high-pressure, high-temperature steam as an input for power. A basic steam generator receives water into a heating chamber or boiler where the water is heated and pressurized before being exhausted as high-temperature, high pressure steam for delivery to a given device to be powered by the steam. Excess heat beyond what is required to heat the water is often exhausted to atmosphere or otherwise wasted.

SUMMARY

A steam generator for converting a fluid to steam comprises a combustion chamber for receiving a combustion fuel into the heating chamber to generate heat within the combustion chamber; a steam chamber surrounding and heated by the combustion chamber to a temperature exceeding the vaporization temperature of the fluid; a heat exchanging chamber surrounding and heated by residual heat of the steam chamber; preheating coil disposed within the heat exchanging chamber and having a fluid inlet for receiving the fluid under pressure into the preheating coil for preheating the fluid within the heat exchanging chamber; an injector communicating with the preheating coil and the steam chamber for injecting a controlled flow of the preheated fluid under pressure into the steam chamber where it flashes to steam and is super-heated to the temperature within the steam chamber; and the steam chamber including a steam outlet for conveying the super-heated steam externally of the steam generator.

The generator has the advantage of preheating the fluid to a super-heated level while under pressure before releasing it to the steam chamber. This yields an instantaneous super-heated charge of high pressure steam within the steam chamber which is immediately available as input to any of a number of devices or systems that rely on steam input for power generation and the like.

In an exemplary embodiment, the steam generator may be coupled at its outlet to the inlet of a rotary pump (vane or Gerotor, for example) for converting the energy of the steam to mechanical or electrical power. The spent steam from the pump is preferably cycled back through the sealed heat exchanger for reheating and delivery back to the pump as part of a closed-loop system.

In an exemplary embodiment, the steam generator may be coupled at its outlet to the inlet of a rotary pump (vane or Gerotor, for example) for converting the energy of the steam to mechanical or electrical power. The spent steam from the pump is preferably cycled back through the sealed heat exchanger for reheating and delivery back to the pump as part of a closed-loop system.

THE DRAWINGS

These and other features and advantages will be better understood when considered in connection with the following detailed description and drawings, in which.

DETAILED DESCRIPTION

Figure 1:
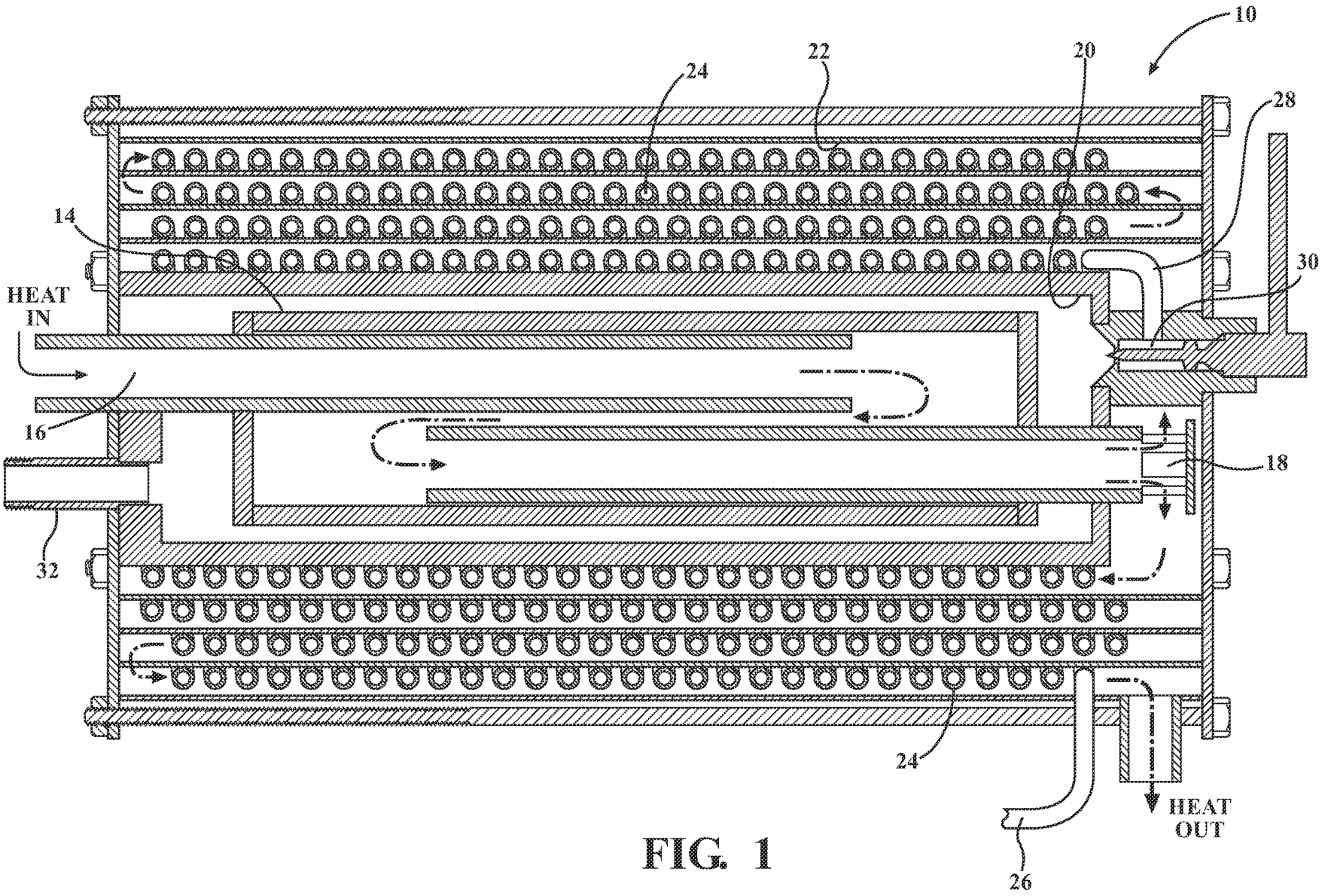
FIG. 1 is a schematic of an embodiment of a steam generator showing heat flow.
Figure 2:
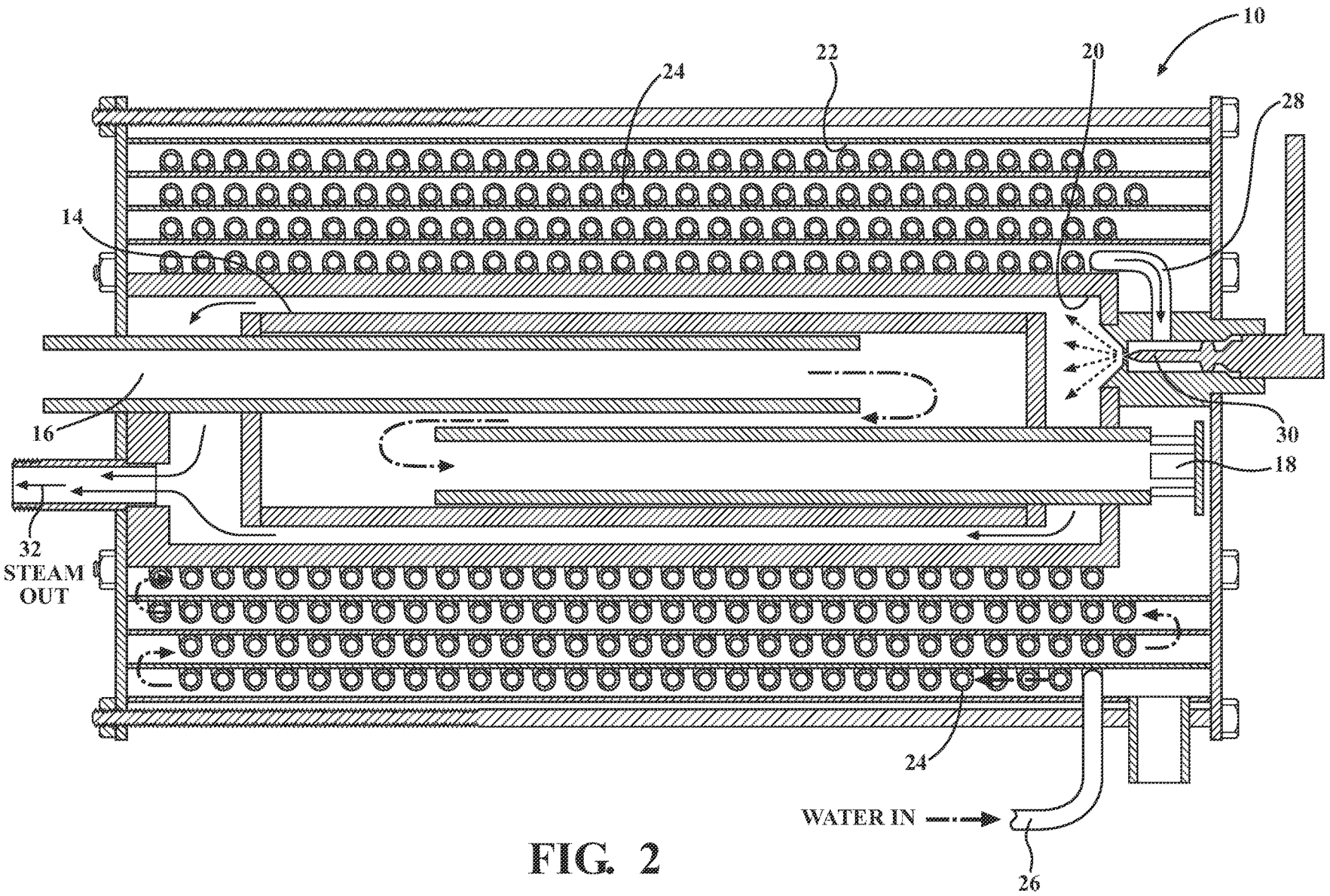
FIG. 2 is a schematic like FIG. 1 but showing water and steam flow.

A steam generator constructed according to an embodiment is illustrated generally at 10 in FIGS. 1 and 2. The steam generator 10 may be a component of a power generation system 12 as illustrated schematically in FIG. 3.

The steam generator 10 operates to convert a fluid, such as water, into steam and includes a combustion chamber 14 having a defined chamber wall with an inlet 16 for admitting a combustible fuel into the chamber, such as a gaseous air/fuel mixture, for heating the combustion chamber to a temperature exceeding a vaporization point of the fluid. The chamber 14 further includes a combustion heat outlet 18 for expelling the combusted fuel from the combustion chamber 14.

The steam generator 10 includes a steam chamber 20 adjacent the combustion chamber 14 and preferably surrounding the combustion chamber 14. The heat from the combustion chamber 14 heats the steam chamber 20 to an elevated temperature above the vaporization temperature of the fluid and which may be the same temperature as that of the combustion chamber 14. The steam chamber 20 includes defined chamber walls which are spaced from the walls of the combustion chamber 14 to define a contained space of the steam chamber 20. The steam chamber 20 is isolated from direct exposure to the combustion fuel of the combustion chamber 14 by the intervening walls and is heated by conduction, convection and/or radiation from the combustion chamber 14.

The steam generator 10 further includes a heat-exchanging chamber 22 having a wall that surrounds and is spaced from the wall of the steam chamber 20. The chamber 22 is heated directly from the hot exhaust coming from the exit 18 of the combustion chamber 14 and is further heated from heat scavenged from the neighboring steam chamber 20. Within the space defined by the heat-exchanging chamber 22 is at least one heat-exchanging coil 24. The coil 24 has an inlet 26 for receiving the fluid into the coil 24 of the chamber 22 from outside the generator 10. The fluid within the coil 24 may be water and it may be delivered by a high pressure feed pump to maintain the fluid under high pressure. The fluid is preheated within the coil 24 and chamber 22 to an elevated temperature that preferably exceeds the vaporization point of the fluid. The pressure of the fluid is sufficiently high to keep the fluid from vaporizing (boiling) within the coil 24 despite the temperature exceeding the nominal boiling point of the fluid. The exact pressures and temperatures will depend on the fluid and the conditions for a given application, but in one example where the fluid is water, the temperature of the fluid in the coil 24 exceed 212° F. and the pressure exceeds 1 psi. More preferably, the water is fed into the coil using a high pressure pump at a pressure of about 2,000 psia and the water may reach temperature approaching 335° F. or more. In another example, the pressure is at 100 psia and the water is at 328° F. or more. In such a state, it is said that the fluid is super-heated.

Figure 3:
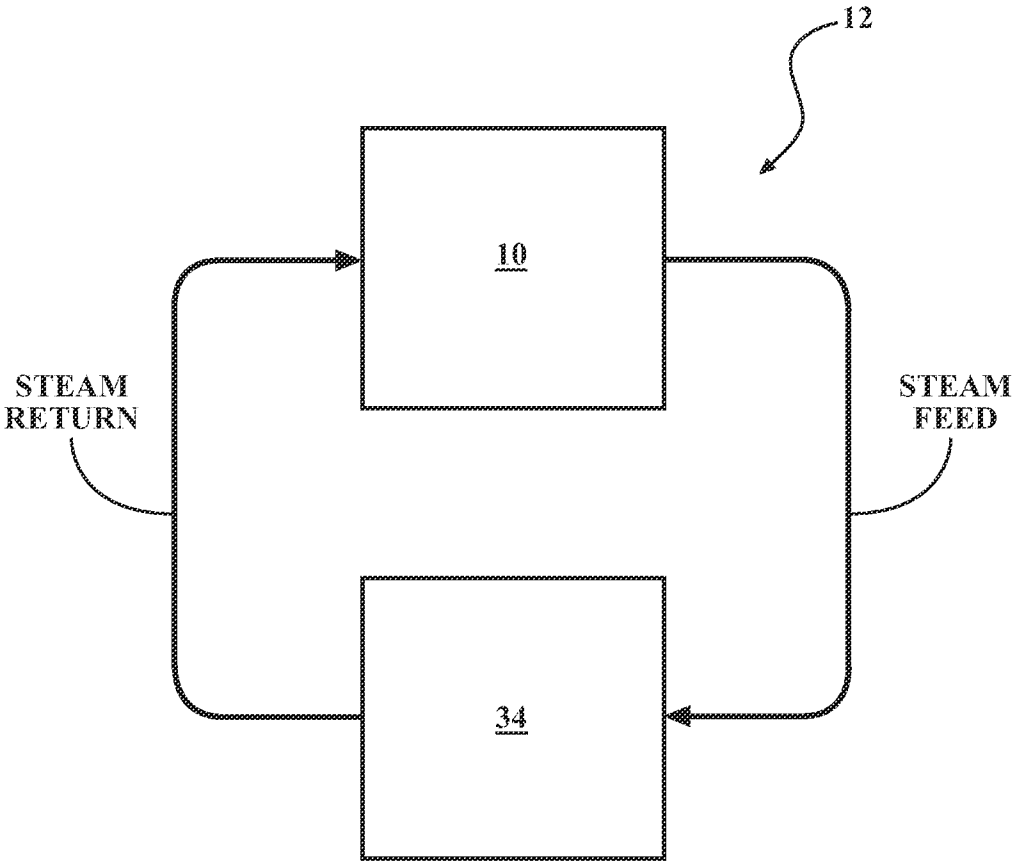
FIG. 3 is a schematic of a power generation system.

The inlet 26 enters the chamber 22 is at a location furthest from the steam chamber 20 and it preferably is coiled or wound inwardly about the wall of the steam chamber 20. The coil 24 has an outlet 28 that is closest to the wall of the steam chamber 20 such that the fluid gets progressively hotter as it flows through the coil 24 and approaches the outlet 28. A flow control valve or nozzle 30 communicates with the outlet 28 of the coil 24 and is in open communication with the steam chamber 20 preferably at or near the hottest region of the chamber 20. The valve 30 is operated to release a controlled flow of the pre-heated (and preferably super-heated) fluid from the confines of the coil 24 directly into the super-heated space of the chamber 20. The sudden drop in pressure and expansion of volume from the transition from the coil 24 to the steam chamber 20 causes an instantaneous flash of the fluid stream to vapor or steam where it is further heated to higher temperatures in the atmosphere of the chamber 22. The steam chamber 20 includes a steam exit or outlet 32 for expelling the super-heated high pressure steam from the generator 10. The expelled steam may be used in connection with any of a number of devices or applications 34, as schematically shown in FIG. 3 that calls for high temperature, high pressure steam, such a turbine or steam-driven motor (e.g., a vane or Gerotor motor) for converting the energy of the steam to mechanical and/or electrical power. The partially or fully exhausted steam from the end-use application 34 may be cycled back through the generator 10 in a closed loop system via the high pressure feed pump that directs the fluid back to the coil 24 within the heat exchanging chamber 22, as also illustrated schematically in FIG. 3.

It will be appreciated that other constructions and uses of the steam generator 10 will be appreciated and envisioned by one of ordinary skill in the art, and having in common the feature of preheated fluid being released in the form of high temperature, high pressure mist into a super-heated chamber where it produces instant super-heated steam in a highly efficient manner.

What is claimed is:

1. A steam generator for converting a fluid to steam, comprising:

a combustion chamber for receiving a combustion fuel into the combustion chamber;

a steam chamber surrounding and heated by the combustion chamber to a temperature exceeding a vaporization temperature of the fluid;

a heat exchanging chamber surrounding and heated by residual heat of the steam chamber;

a preheating coil disposed within the heat exchanging chamber and having a fluid inlet for receiving the fluid under pressure into the preheating coil for preheating the fluid within the heat exchanging chamber;

an injector communicating with the preheating coil and the steam chamber for injecting a controlled flow of the preheated fluid under pressure into the steam chamber where it flashes to steam and is super-heated to the temperature of the steam chamber; and a steam outlet for conveying the super-heated steam externally of the steam generator.

2. The steam generator of claim 1, wherein the fluid is water.

3. The steam generator of claim 2, wherein the steam chamber and heat exchanging chamber are separated by a wall.

4. The steam generator of claim 2, wherein a sudden drop in pressure and a corresponding sudden expansion in volume of the fluid occurs from the transition from the preheating coil to the steam chamber and causes the instantaneous flash of the fluid stream to vapor or steam where it is further heated to higher temperatures in the steam chamber.

* * * * *